US008624939B2

(12) United States Patent
Peng et al.

(10) Patent No.: US 8,624,939 B2
(45) Date of Patent: Jan. 7, 2014

(54) LIQUID CRYSTAL DISPLAY DEVICE AND DRIVING METHOD THEREOF

(75) Inventors: Huan-Xi Peng, Shenzhen (CN); Sha Feng, Shenzhen (CN)

(73) Assignees: Innocom Technology (Shenzhen) Co., Ltd. (TW); Chimei Innolux Corporation (TW)

( * ) Notice: Subject to any disclaimer, the term of this patent is extended or adjusted under 35 U.S.C. 154(b) by 777 days.

(21) Appl. No.: 12/818,174

(22) Filed: Jun. 18, 2010

(65) Prior Publication Data

US 2011/0122166 A1 May 26, 2011

(51) Int. Cl.
*G09G 5/10* (2006.01)

(52) U.S. Cl.
USPC ..... 345/690; 345/87; 345/89

(58) Field of Classification Search
None
See application file for complete search history.

(56) References Cited

U.S. PATENT DOCUMENTS

| | | | | |
|---|---|---|---|---|
| 2007/0132683 | A1 | 6/2007 | Kong | |
| 2007/0296668 | A1* | 12/2007 | Kim et al. | 345/89 |
| 2009/0109247 | A1* | 4/2009 | Kimura | 345/690 |

FOREIGN PATENT DOCUMENTS

| | | | |
|---|---|---|---|
| CN | 101192389 | A | 6/2008 |
| JP | 2004233949 | A | 8/2004 |
| TW | 200934045 | A | 7/2009 |
| TW | 200709141 | B | 7/2011 |

* cited by examiner

*Primary Examiner* — Joseph Haley
*Assistant Examiner* — Ifedayo Iluyomade
(74) *Attorney, Agent, or Firm* — Bacon & Thomas, PLLC

(57) ABSTRACT

A liquid crystal display (LCD) device includes a display control circuit to receive data of each frame of an external image signal and a liquid crystal panel. When the data of an n+1 frame currently received is the same as that of an n frame previously received, the display control circuit outputs first gray scale voltages corresponding to the data of the n+1 frame to drive the liquid crystal panel. When the data of the n+1 frame is different from that of the n frame, the display control circuit generates data of at least one inserted frame between the data of the n and the n+1 frames, and outputs second gray scale voltages respectively corresponding to the data of the at least one inserted frame and the n+1 frame to drive the liquid crystal panel to display first an image of the least one inserted frame and then that of the n+1 frame. An absolute value of a second gray scale voltage exceeds that of a first gray scale voltage for a same gray scale.

15 Claims, 2 Drawing Sheets

LIQUID CRYSTAL DISPLAY DEVICE AND DRIVING METHOD THEREOF

BACKGROUND

1. Technical Field

The present disclosure generally relates to display devices, and particularly to a liquid crystal display (LCD) device and a driving method for the LCD device.

2. Description of Related Art

Commonly used LCD devices have the advantages of portability, low power consumption, and low radiation, and are widely used in various electronic devices such as notebooks, personal digital assistants (PDAs), video cameras, televisions, and others. However, many of these LCD devices have certain shortcomings, such as a long response time because liquid crystals in the LCD devices have a certain viscosity, which results in blurring when the LCD devices display moving images due to the slow response time.

Thus, a motion estimation/motion compensation (ME/MC) technology for solving the blurring problem has been proposed. That is, when an LCD device displays an image, a data processing chip thereof receives any two consecutive frames of the image, estimates and compares the two consecutive frames, and obtains new data in a range between the data of the two consecutive frames according to data of the two consecutive frames. The new data generates a new frame with a new image. The data processing chip then outputs the data of the former of the two consecutive frames, the data of the new image, and the data of the latter of the two consecutive frames, sequentially. Accordingly, when the LCD device displays a moving image, blur is eliminated or lessened.

However, when the LCD device inserts the new frame between the two consecutive frames, a frame frequency of an image signal output by the LCD device accordingly needs to be double that of an original image signal received by the LCD device. In the same frame period, charge time of pixels of the LCD device is halved, which lowers the contrast ratio of the LCD device. Display of the LCD is, accordingly, deteriorated.

What is needed, therefore, is an LCD device and a driving method thereof which can overcome the described limitations.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Reference will now be made to the drawings to describe various embodiments in detail.

Figure 1:
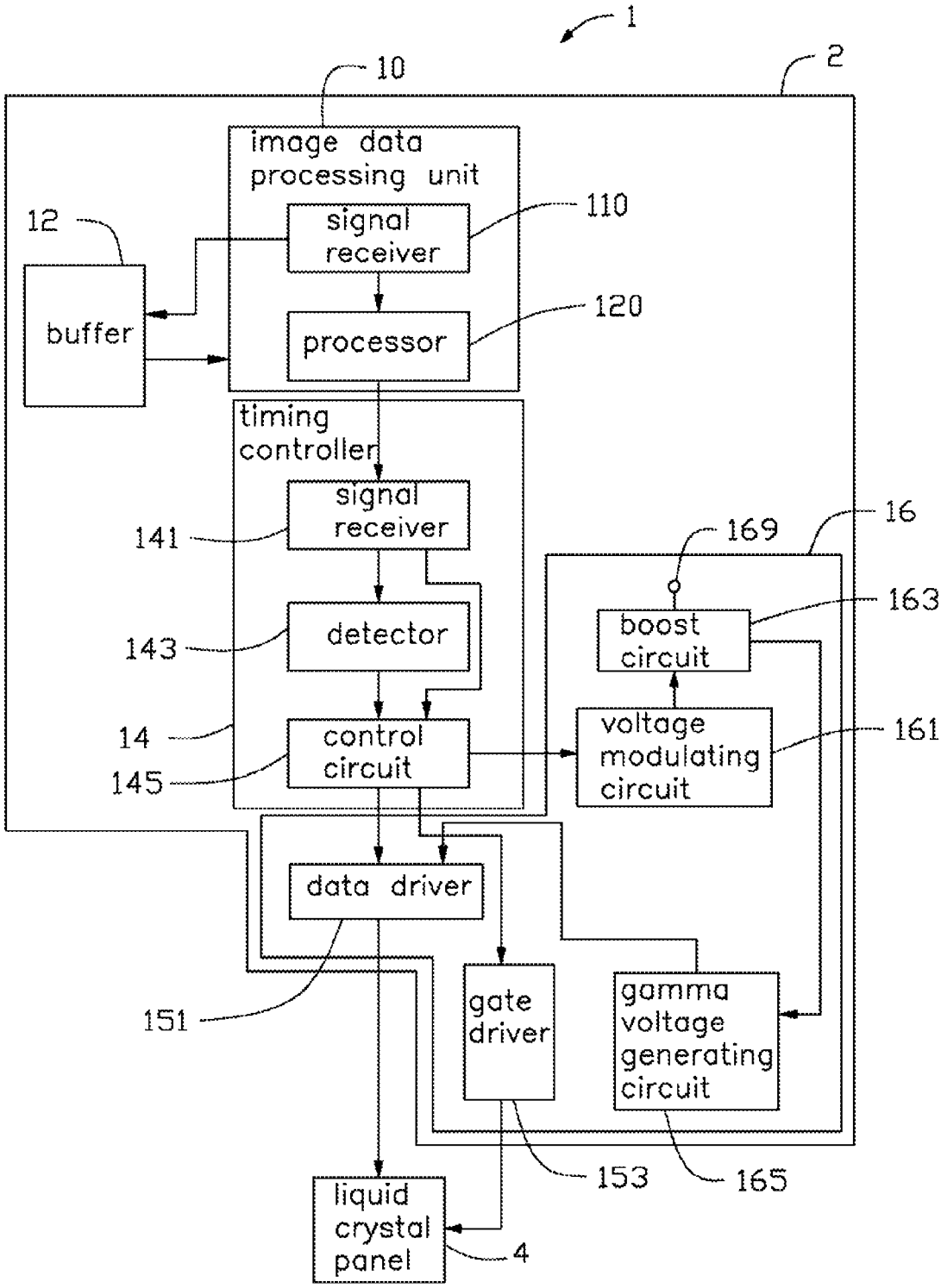
FIG. 1 is a schematic circuit block diagram of one embodiment of an LCD device, the LCD device including a boost circuit and a voltage modulating circuit.

Referring to FIG. 1, a schematic circuit block diagram of one embodiment of an LCD device 1 is shown. The LCD device 1 includes a display control circuit 2 and a liquid crystal panel 4. The display control circuit 2 directs the liquid crystal panel 4 to display images, and includes an image data processing unit 10, a buffer 12, a timing controller 14, and a driving circuit 16.

The image data processing unit 10 functions as a ME/MC. The image data processing unit 10 receives data of each frame of an external image signal and compares data of an n+1 frame and data of an n frame, where n is a natural number, the n frame denotes the previous frame of the external image signal received by the image data processing unit 10, and the n+1 frame denotes a current frame of the external image signal received by the image data processing unit 10. If the data of the n+1 frame is the same as that of the n frame, the image data processing unit 10 determines the image represented by the data of the n+1 frame is a still image, then converts the data of the n+1 frame to obtain a converted signal, and outputs the converted signal. If the data of the n+1 frame is different from that of the n frame, the image data processing unit 10 determines the image represented by the data of the n+1 frame is a moving image, then generates new data, which can form a frame of a new image signal, by calculating the data of the n frame and the data of n+1 frame, where the frame of the new image signal can be defined as an inserted frame, and the new image represented by data of the inserted frame is a transitional frame from the n frame to the n+1 frame. The image data processing unit 10 converts the data of the inserted frame to obtain a converted signal, and outputs the converted signal between the n frame and the n+1 frame, namely, after the n frame and before the n+1 frame.

The buffer 12, such as a memory buffer, stores the data of the n frame received by the image data processing unit 10, and outputs the data of the n frame and updates the storage from the data of the n frame to that of the n+1 frame when the image data processing unit 10 receives the data of the n+1 frame.

The timing controller 14 receives the converted signal output from the image data processing unit 10 corresponding to each frame, detects a frame frequency of each frame, and outputs a control signal according to the frame frequency of each frame to the driving circuit 16. When the data of the n+1 frame received by the image data processing unit 10 is the same as that of the n frame, the frame frequency of the n+1 frame is defined as a first frequency. When the data of the n+1 frame is different from that of the n frame, the frame frequencies of the inserted frame and the n+1 frame are the same and defined as a second frequency. The second frequency may be double the first frequency, and the first frequency actually equal to the frame frequency of each frame of the external image signal. When the first frequency is detected, the timing controller 14 outputs a first control signal to the driving circuit 16 corresponding to the first frequency, and then the driving circuit 16 outputs a plurality of first gray scale voltages to drive the liquid crystal panel 4 to display the image represented by the data of the n+1 frame. When the second frequency is detected, the timing controller 14 outputs a second control signal to the driving circuit 16 corresponding to the second frequency, and the driving circuit 16 outputs a plurality of second gray scale voltages to drive the liquid crystal panel 4 to sequentially display the images represented by the data of inserted frame and the n+1 frame.

The first and the second gray scale voltages are polarity inversion signals relative to a reference voltage, where the gray scale voltage more than the reference voltage is defined as positive polarity gray scale voltage, and the gray scale voltage less than the reference voltage is defined as negative polarity gray scale voltage. For the same gray scale, an absolute value of the second gray scale voltage is predetermined to exceed that of the first gray scale voltage. For example, if an image of the n+1 frame displays a gray scale of 128 having positive polarity, when the timing controller 14 detects that the frame frequency of the n+1 frame is the first frequency, the driving circuit 16 outputs a first gray scale voltage, the first gray scale voltage is a positive polarity gray scale voltage, and may be +4V, and when the timing controller 14 detects that the frame frequency of the n+1 frame is the second frequency, the driving circuit 16 outputs a second gray scale voltage, the second gray scale voltage is a positive polarity gray scale voltage, and may be +4.3V. If an image of the n+1 frame displays a gray scale of 128 having negative polarity, when the timing controller 14 detects that the frame frequency of the n+1 frame is the first frequency, the driving circuit 16 outputs a first gray scale voltage, the first gray scale voltage is a negative polarity gray scale voltage, and may be about −4V, and when the timing controller 14 detects that the frame frequency of the n+1 frame is the second frequency, the driving circuit 16 outputs a second gray scale voltage, the second gray scale voltage is a negative polarity gray scale voltage, and may be about −4.3V. That is, the absolute value of the second gray scale voltage exceeds that of the first gray scale voltage for the same gray scale.

The image data processing unit 10, the buffer 12, the timing controller 14, and the driving circuit 16 are detailed as follows, where it is to be understood, an exemplary and a preferred embodiment. Even so, it will be apparent to those skilled in the art that various modifications and variations can be made without departing from the spirit or scope of the disclosure.

The image data processing unit 10 includes a signal receiver 110 and a processor 120. The signal receiver 110 receives the data of each frame of the external image signal. When the signal receiver 110 receives the data of the n+1 frame, the processor 120 reads the data of the n frame from the buffer 12, and the signal receiver 110 outputs the data of the n+1 frame to the processor 120 and the buffer 12. The processor 120 compares the data of the n frame and the data of the n+1 frame. If the data of the n frame and the n+1 frame are the same, the processor 120 converts the data of the n+1 frame to a low voltage differential signal (LVDS), and outputs the LVDS of the n+1 frame to the timing controller 14. If the data of the n frame and the n+1 frame are different, the processor 120 calculates according to the data of the n frame and the n+1 frame, and generates data of an inserted frame, converts the data of the inserted frame to a corresponding LVDS, and outputs the LVDS of the inserted frame to the timing controller 14. The processor 120 converts the data of the n+1 frame to a corresponding LVDS, and outputs the LVDS of the n+1 frame to the timing controller 14.

The timing controller 14 includes a signal receiver 141, a detector 143, and a control circuit 145. The signal receiver 141 receives the LVDSs output from the processor 120. The detector 143 detects the LVDSs, and obtains a frame frequency of each frame. When the frame frequency of the current frame detected is the first frequency, the detector 143 outputs the first control signal corresponding to the first frequency to the control circuit 145. When the frame frequency of the current frame detected is the second frequency, the detector 143 outputs the second control signal corresponding to the second frequency to the control circuit 145. The control circuit 145 receives the first and/or second control signals and the LVDSs output from the signal receiver 141, converts the LVDSs to reduced swing differential signals (RSDSs), and outputs the RSDSs with data control signals and gate control signals to the driving circuit 16.

The driving circuit 16 includes a voltage modulating circuit 161, a boost circuit 163, a gamma voltage generating circuit 165, a data driver 151, and a gate driver 153. The voltage modulating circuit 161, the boost circuit 163, the gamma voltage generating circuit 165, and the data driver 151 are connected in serial. The voltage modulating circuit 161, the data driver 151, and the gate driver 153 are connected to the control circuit 145. The boost circuit 169 includes an input terminal 169 to receive a direct current (DC) voltage of an external power supply. The data driver 151 and the gate driver 153 are connected to the liquid crystal panel 4.

When the control circuit 145 receives the first control signal, the control circuit 145 outputs the first control signal to control the voltage modulating circuit 161. Then the boost circuit 163 generates and outputs a first voltage to the gamma voltage generating circuit 165. The gamma voltage generating circuit 165 divides the first voltage, and generates and outputs a plurality of first gamma voltages to the data driver 151.

When the control circuit 145 receives the second control signal, the control circuit 145 outputs the second control signal to control the voltage modulating circuit 161.

Then voltage modulating circuit 161 directs the boost circuit 163 to generate and output a second voltage to the gamma voltage generating circuit 165. The gamma voltage generating circuit 165 divides the second voltage, and generates and outputs a plurality of second gamma voltages to the data driver 151.

The gate driver 153 receives the gate control signals from the control circuit 145 and outputs gate signals to the liquid crystal panel 4 according to the gate control signals. The data driver 151 receives the first and the second gamma voltages, the RSDSs, and the data control signals, and outputs data signals to the liquid crystal panel 4 according to the data control signals. When the data driver 151 receives the first gamma voltages, the data driver 151 generates a plurality of first gray scale voltages, and outputs the first gray scale voltages to the liquid crystal panel 4 corresponding to the gray scales represented by the RSDSs. When the data driver 151 receives the second gamma voltages, the data driver 151 generates a plurality of second gray scale voltages, and outputs the second gray scale voltages to the liquid crystal panel 4 corresponding to the gray scales represented by the RSDSs.

The liquid crystal panel 4 is driven by the gate signals, the data signals and the gray scale voltages to display images. For the same gray scale, the absolute value of the second gray scale voltage is predetermined to exceed that of the first gray scale voltage.

Figure 2:
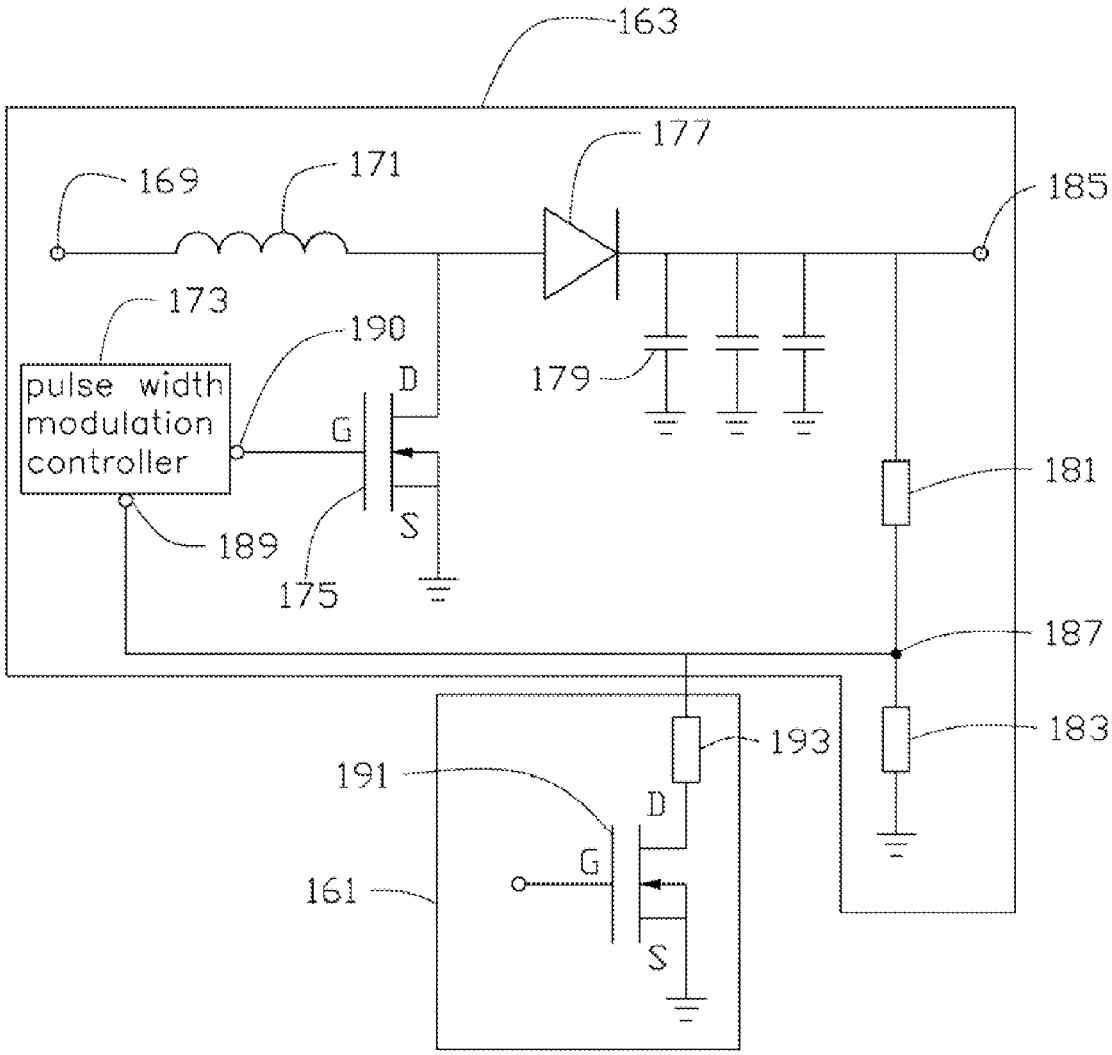
FIG. 2 is a schematic circuit diagram of one embodiment of the boost circuit and the voltage modulating circuit of FIG. 1.

Referring to FIG. 2, a schematic circuit diagram of the voltage modulating circuit 161 and the boost circuit 163 is shown. The boost circuit 163 includes an inductor 171, a pulse width modulation (PWM) controller 173, a transistor 175, a diode 177, a plurality of capacitors 179, a first resistor 181, a second resistor 183, and an output terminal 185. The voltage modulating circuit 161 includes a transistor 191 and a resistor 193. The transistors 175 and 191 may be N-channel metal oxide semiconductor (NMOS) transistors.

One terminal of the inductor 171 is connected to the input terminal 169, and the other terminal of the inductor 171 is connected to an anode of the diode 177. A cathode of the diode 177 is connected to the output terminal 185. The capacitors 179 are connected in parallel between the output terminal 185 and ground. The first and the second resistors 181, 183 are connected in serial, one terminal of the first resistor 181 is connected to the output terminal 185, and one terminal of the second resistor 183 is grounded. A node 187 is defined at a connection between the first and the second resistors 181, 183. The PWM controller 173 includes an input terminal 189 and an output terminal 190, and a reference voltage and a predetermined value. The input terminal 189 is connected to the node 187. The transistor 175 includes a gate electrode G, a drain electrode D, and a source electrode S. The gate electrode G is connected to the output terminal 190, the drain electrode D is connected to the anode of the diode 177, and the source electrode S is grounded.

The transistor 191 includes a gate electrode G, a drain electrode D, and a source electrode S. The gate electrode G of the transistor 191 is connected to the control circuit 145, the drain electrode D of the transistor 191 is connected to the node 187 via the resistor 193, and the source electrode S of the transistor 191 is grounded.

When the voltage modulating circuit 161 receives the first control signal from the control circuit 145, the transistor 191 is switched on, a voltage on the node 187 is pulled down such that a difference between the voltage on the node 187 and the reference voltage is less than the predetermined value. Accordingly, the PWM controller 173 outputs a first square-wave pulse signal to switch the transistor 175 on or off. When the PWM controller 173 switches off the transistor 175 via the first square-wave pulse signal, and the diode 177 is cut off, the conductor 171 receives the DC voltage of the external power supply via the input terminal 169 and charges. When the PWM controller 173 switches on the transistor 175 via the square-wave pulse signal, and the diode 177 is conducted, the conductor 171 discharges and the capacitors 179 charges, until an output voltage of the output terminal 185 equals the first voltage.

When the voltage modulating circuit 161 receives the second control signal from the control circuit 145, the transistor 191 is switched off. A voltage on the node 187 is approximately equal to a divided voltage on the resistor 183, and a difference between the voltage on the node 187 and the reference voltage exceeds the predetermined value. Accordingly, the PWM controller 173 outputs a second square-wave pulse signal to the transistor 175 to switch the transistor 175 on or off. The duty ratio of the second square-wave pulse signal exceeds that of the first square-wave pulse signal. When the PWM controller 173 switches the transistor 175 off via the second square-wave pulse signal, and the diode 177 is cut off, the conductor 171 receives the DC voltage of the external power supply via the input terminal 169 and charges. Due to duty ratio of the second square-wave pulse signal exceeding that of the first square-wave pulse signal, a period when the transistor 175 is switched off is longer. Thus, a charge time of the conductor 171 is longer and the energy stored by the conductor 171 is accordingly higher. When the PWM controller 173 switches on the transistor 175 via the second square-wave pulse signal, and the diode 177 is conducted, the conductor 171 discharges and the capacitor 179 charges, until an output voltage of the output terminal 185 equals the second voltage. Accordingly, the second voltage exceeds the first voltage.

For example, if the DC voltage provided by the external power supply is 5V, the first voltage equals 12V and the second voltage is 14V, a contrast ratio of an image displayed by the liquid crystal 4 under driven by the second gray scale voltages corresponding to the second voltage can be substantially the same as that under driven by the first gray scale voltages corresponding to the first voltage.

The LCD device 1 detects the frame frequency of each frame of an image, when the frame frequency is the first frequency, the first gray scale voltages are provided to the liquid crystal panel 4. When the frame frequency is the second frequency, the second gray scale voltages are provided to the liquid crystal panel 4. Thus, when the data of the n+1 frame is different from that of the n frame, an image of the inserted frame and an image of the n+1 frame are displayed by driven under the second gray scale voltages. Due to the second gray scale voltage exceeding the first gray scale voltage for the same gray scale, even though the second frequency exceeds the first frequency and in a certain frame period a charge time of pixels of the liquid crystal panel 4 is short, the pixels can be charged enough to be driven by a larger second gray scale voltages. Therefore, the contrast ratio and the display of the LCD device 1 are improved.

In other alternative embodiments, the buffer 12 can be integrally formed in the image data processing unit 10. The transistor 175 can be integrally formed in the PWM controller 163. The timing controller 14 can convert the LVDSs to mini LVDSs. When the data of the n+1 frame is different from that of the n frame, the image data processing unit 10 can generate more than one inserted frame of images between the n frame and the n+1 frame of images, and accordingly the frame frequency of the inserted frames can be three times more than the frame frequency of the external image signal received by the image data processing unit 10.

It is believed that the present embodiments and their advantages will be understood from the foregoing description, and it will be apparent that various changes may be made thereto without departing from the spirit and scope of the embodiments or sacrificing all of their material advantages.

What is claimed is:

1. A liquid crystal display (LCD) device, comprising:

a display control circuit to receive data of each frame of an external image signal; and a liquid crystal panel;

wherein when the data of an n+1 frame currently received by the display control circuit is the same as that of an n frame previously received by the display control circuit, where n is a natural number, the display control circuit outputs a plurality of first gray scale voltages corresponding to the data of the n+1 frame to drive the liquid crystal panel, and when the data of the n+1 frame is different from that of the n frame, the display control circuit generates data of at least one inserted frame of an image signal between the data of the n frame and the n+1 frame, and outputs a plurality of second gray scale voltages respectively corresponding to the data of the at least one inserted frame and the n+1 frame to drive the liquid crystal panel to display first an image of the least one inserted frame and then an image of the n+1 frame, wherein an absolute value of a second gray scale voltage exceeds that of a first gray scale voltage for a same gray scale, and wherein when the data of the n+1 frame is the same as that of the n frame, a frame frequency of the n+1 frame equals that of the external image signal, when the data of the n+1 frame is different from that of the n frame, a frame frequency of the at least one inserted frame equals that of the successive n+1 frame, and exceeds that of the external image signal.

2. The LCD device of claim 1, wherein the display control circuit comprises an image data processing unit, the image data processing unit comparing the data of the n frame and the n+1 frame, and if the data of the n+1 frame is the same as that of the n frame, converting the data of the n+1 frame to a converted signal and outputting the converted signal, and if the data of the n+1 frame is different from that of the n frame, generating the data of the at least one inserted frame by calculating the data of the n frame and the n+1 frame, converting the data of the at least one inserted frame and the n+1 frame to a converted signal, and outputting the converted signal.

3. The LCD device of claim 2, wherein the display control circuit further comprises a buffer to store the data of the n frame before comparison with the data of the n+1 frame.

4. The LCD device of claim 2, wherein the display control circuit further comprises a timing controller, the timing controller receiving the converted signal, detecting the frame frequency of each frame corresponding to the converted signal, and outputting a control signal according to the frame frequency.

5. The LCD device of claim 4, wherein when the data of the n+1 frame is the same as that of the n frame, the frame frequency of the n+1 frame detected by the timing controller is defined as a first frequency, when the data of the n+1 frame is different from that of the n frame, the frame frequency of the at least one inserted frame and the n+1 frame detected by the timing controller is defined as a second frequency, when the timing controller detects the first frequency, the timing controller outputs a first control signal, and when the timing controller detects the second frequency, the timing controller outputs a second control signal.

6. The LCD device of claim 5, wherein the display control circuit further comprises a driving circuit, the driving circuit generating the plurality of first gray scale voltages according to the first control signal, and generating the plurality of second gray scale voltages according to the second control signal.

7. The LCD device of claim 6, wherein the driving circuit comprises a voltage modulating circuit and a boost circuit connected to the voltage modulating circuit, the boost circuit receiving a voltage provided by an external power supply, when the voltage modulating circuit receives the first control signal, the boost circuit processing the voltage and outputting a first voltage according to the first control signal, and when the voltage modulating circuit receives the second control signal, the boost circuit processing the voltage and outputting a second voltage according to the second control signal.

8. The LCD device of claim 7, wherein the boost circuit comprises an input terminal, a pulse width modulation controller, a first transistor, an inductor, a diode, a plurality of capacitors, a first resistor, a second resistor, and an output terminal, one terminal of the inductor connected to the input terminal, the other terminal of the inductor connected to an anode of the diode, a cathode of the diode connected to the output terminal, the plurality of capacitors parallel connected between the output terminal and ground, the first and the second resistors connected between the output terminal and the ground in serial, wherein a node is defined at a connection between the first and the second resistors, the pulse width modulation controller comprising an input and an output, the input connected to the node, and the output connected to a control terminal of the first transistor, and two other terminals of the first transistor respectively connected to the anode of the diode and the ground.

9. The LCD device of claim 8, wherein the voltage modulating circuit comprises a second transistor and a third resistor, one terminal of the third resistor connected to the node, the other terminal of the third resistor grounded via the second transistor, and a control terminal of the second transistor receiving the first or second control signal from the timing controller.

10. The LCD device of claim 9, wherein a reference voltage and a predetermined value are disposed in the pulse width modulation controller, and when the voltage modulating circuit receives the first control signal to switch on the second transistor, a voltage on the node is pulled down, a difference between the voltage on the node and the reference voltage is less than the predetermined value, the pulse width modulation controller outputs a first square-wave pulse signal to control the first transistor, and the output terminal outputs the first voltage.

11. The LCD device of claim 10, wherein when the voltage modulating circuit receives the second control signal to switch off the second transistor, a difference between the voltage on the node and the reference voltage exceeds the predetermined value, the pulse width modulation controller outputs a second square-wave pulse signal to control the first transistor, and the output terminal outputs the second voltage, a duty ratio of the second square-wave pulse signal exceeding that of the first square-wave pulse signal.

12. The LCD device of claim 7, wherein the driving circuit further comprises a gamma voltage generating circuit and a data driver, the gamma voltage generating circuit receiving the first voltage to generate a first gamma voltage, the data driver receiving the first gamma voltage to generate the plurality of the first gray scale voltage, and the gamma voltage generating circuit receiving the second voltage to generate a second gamma voltage, the data driver receiving the second gamma voltage to generate the plurality of the second gray scale voltage.

13. A method for driving a liquid crystal display (LCD) device, the LCD device comprising a display control circuit to receive and process data of each frame of an external image signal and a liquid crystal panel to display images, the method comprising:

receiving the data of each frame of an external image signal;

comparing the data of an n+1 frame currently received by the display control circuit with that of an n frame previously received by the display control circuit, where n is a natural number;

generating a plurality of first gray scale voltages corresponding to the data of the n+1 frame to drive the liquid crystal panel when the data of the n+1 frame is the same as that of the n frame; and generating data of at least one inserted frame of an image signal between the data of the n frame and the n+1 frame when the data of the n+1 frame is different from that of the n frame, and outputting a plurality of second gray scale voltages respectively corresponding to the data of the at least one inserted frame and the n+1 frame to drive the liquid crystal panel to display first an image of the least one inserted frame and then an image of the n+1 frame;

wherein an absolute value of a second gray scale voltage exceeds that of a first gray scale voltage for a same gray scale, and wherein when the data of the n+1 frame is the same as that of the n frame, a frame frequency of the n+1 frame equals that of the external image signal and is defined as a first frequency, when the data of the n+1 frame is different from that of the n frame, a frame frequency of the at least one inserted frame equals that of the successive n+1 frame and is defined as a second frequency, and the second frequency exceeds the first frequency.

14. The method of claim 13, further comprising storing the data of the n frame in a buffer before comparing the data of the n+1 frame with that of an n frame.

15. The method of claim 13, further comprising detecting the frame frequency of each frame after comparing the data of the n+1 frame with that of an n frame.

* * * * *